US006383727B1

(12) United States Patent
Twist et al.

(10) Patent No.: US 6,383,727 B1
(45) Date of Patent: May 7, 2002

(54) METHOD AND SYSTEM FOR PROCESSING PHOTOGRAPHIC MATERIAL WHICH INCLUDES WATER RECOVERY FROM HUMID AIR FOR RE-USE IN THE PROCESSING

(75) Inventors: Peter J. Twist, Bucks; Nigel R. Wildman, Herts, both of (GB); Eric R. Schmittou, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/705,410

(22) Filed: Nov. 3, 2000

(51) Int. Cl.[7] ..... G03C 5/395; G03C 7/44
(52) U.S. Cl. ..... 430/398
(58) Field of Search ..... 430/398

(56) References Cited

U.S. PATENT DOCUMENTS

| | | | | |
|---|---|---|---|---|
| 4,940,134 A | * | 7/1990 | Aoki et al. | 202/202 |
| 5,402,195 A | | 3/1995 | Glover et al. | 354/321 |
| 5,452,045 A | | 9/1995 | Koboshi et al. | 354/324 |
| 5,692,188 A | | 11/1997 | Watts et al. | 396/634 |

FOREIGN PATENT DOCUMENTS

| | | |
|---|---|---|
| JP | 3-266840 A | 11/1991 |
| JP | 6-095329 A | 4/1994 |
| JP | 8-057202 A | 3/1996 |
| JP | 9-258405 A | 10/1997 |

* cited by examiner

*Primary Examiner*—Hoa Van Le
(74) *Attorney, Agent, or Firm*—David A. Novais

(57) ABSTRACT

The present invention relates to a processing system and method for processing photographic material. The processing system and method of the invention is adapted to recover water from humid air for reuse in the processor, as well as convert a liquid waste processing solution into a dry waste for disposal. In the system and method of the present invention, heated air is circulated through the processor and comes into contact with a cold surface to condense the heated air. The water resulting from this contacting of the heated air with the cold surface can be collected and recycled back to the processor for reuse in the processor. Further, waste solution can be absorbed by a matting material appropriately placed in the processor which evaporates the waste solution to a solid waste for subsequent disposal.

7 Claims, 2 Drawing Sheets

METHOD AND SYSTEM FOR PROCESSING PHOTOGRAPHIC MATERIAL WHICH INCLUDES WATER RECOVERY FROM HUMID AIR FOR RE-USE IN THE PROCESSING

FIELD OF THE INVENTION

The present invention relates generally to processing systems and methods for silver halide photographic elements. The present invention particularly relates to the reuse, for photographic processing purposes, of water collected from several sources of water vapor and water in the photographic processor. The invention also relates to a method and system for the formation of dry waste from liquid waste effluent from the photographic process.

BACKGROUND OF THE INVENTION

It is desirable, especially with small scale dispersed photofinishing equipment or stand-alone equipment, to reduce the number and complexity of operator interventions required to process photographic materials. One way to achieve this is to package the processing solutions as concentrates, which are then mixed with water by the operator or mixed automatically by the processing machine to provide the working strength solution concentrations. The KODAK SM system automatically meters these concentrates into the processing machine and adds water, so that no chemical mixing is required by the operator. It is, however, still necessary to provide the machine with water periodically. In highly dispersed photofinishing, it is not desirable to have to mix chemicals by hand frequently or to have to provide the machine with water frequently.

Less expensive and more economical photographic processing equipment can be built if the automatic mixing and dilution of processing chemistry concentrates can be avoided. With these processing machines, processing chemicals are supplied at the operating strength required by the processor, eliminating the need to dilute by hand and the need for accurate pumps for automatic mixing. This saves cost in manufacturing the processing machine. It is still desirable to minimize the number of interventions required by the operator to replace empty packages of processing chemistry (in liquid or solid form) or to refill the processor with water used for processing.

Therefore, it is desirable that the processing equipment conserve its on-board water or be able to recover water after it has been used to process photographic materials.

In addition, it is desirable to provide waste from the processing machine that is in a dry state, which can simplify waste disposal.

There has been interest in recovering water from waste photographic processing solutions in order to lessen the amount of water consumed by the photographic process and to concentrate the waste. One way to accomplish this, for example, is to use evaporation means to generate fresher water as a vapor or distillate from an evaporation/condensation unit.

JP 8057202A describes an evaporator equipped with a heat pump which includes a compressor, a heat radiator, an expanding bulb, and a heat absorber. The heat radiator is used to heat and evaporate photographic processing waste liquid. The heat absorber is used to cool and condense the vapor of the liquid. Evaporation and condensation occur under reduced pressure. The evaporator is used to concentrate photographic processing waste and is not an integral part of a processing machine. Further, the condenser is not used to collect water from the processor dryer unit or other parts of the processor, only from a batch of waste liquid.

JP 6095329A describes a vacuum heat pump-type of evaporator for concentrating photographic waste liquid, a condenser for cooling the vapor generated from the evaporator, and a tank for recovering the condensed water. The system operates under reduced pressure. The concentrator is connected with a photographic automatic processing unit. The collected condensate water is reused as the dissolving water and/or dilution water in the preparation of the liquid in the photographic processing unit. The condenser is not used to collect water from parts of the processor, only from processor waste liquid.

JP 3266840A describes an automatic processing apparatus for silver halide photographic material in which a condenser of a heat pump is used to condense water from evaporated photographic liquid waste only.

JP 9258405A describes an automated photographic processing apparatus in which waste liquid is evaporated and concentrated. Moist air containing the evaporated moisture is blown into a dehumidifying device, from which the air is released as dry air into the atmosphere. The moisture in this dehumidifying device is condensed and is stored in a water storage tank.

U.S. Pat. No. 5,452,045 describes an automated photographic processing apparatus containing a distillation device to evaporate processing waste liquid and collect distilled water from the evaporated waste, returning the water to the processor for use. Additionally, the apparatus may contain a separator (dehumidifier) to separate water from air in the vicinity of the processor, for use within the processor.

The above described systems for water recovery and reuse have been limited to evaporating, condensing, and collecting water from photographic waste liquids or from surrounding ambient air. These systems have not been used to recover water from humid air sources within the photographic processor.

Furthermore, the conventional systems discussed above do not address the evaporating and drying of waste liquids from an absorbent medium within a processing chamber of the processing machine. This approach increases the surface area for evaporation and increases the evaporation and water recovery rate.

Necessary components of a photographic processor which contain water vapor are useful sources of recoverable water. These sources of water are the sections of the processor in which the photographic elements are dried, in which the photographic solutions themselves partially or completely evaporate during the course of processing, or in which waste processing solutions are evaporated. An example of the last two is the controlled temperature chamber in which batch processing can be performed with a processor as described in GB 0023091.2, with a drum-type of processor as described in U.S. Pat. No. 5,692,188, with a drum processor such as the R-11 Drum Processor manufactured by Eastman Kodak Company, or with a belt-type of processor as described in U.S. Pat. No. 5,402,195. This chamber may contain within it a vessel to receive waste solutions from the photographic process for evaporation to render the waste dry.

SUMMARY OF THE INVENTION

An object of the present invention is to solve the problem of recovery of water from sources of water vapor within a photographic processor. With the arrangement of the present invention, the overall consumption of water by the processor is reduced. The integration of the water recovery system with the processor results in a more compact unit than the use of a separate processor and water recovery unit.

In another embodiment, a rapid evaporation method and system results in the generation of solid waste from liquid photographic waste and the recovery of water for reuse from the water vapor from the evaporated waste.

Therefore, the present invention relates to a system and method that involves recovering and collecting fresh water for reuse from several sources of water, and also relates to a system and method for the formation of dry waste.

In a feature of the invention, a condenser unit of a heat-pump or cooling device is used to recover water from the sources of water vapor in a processor of photographic material so that the water may be reused in the photographic process. Humid air from the chambers of the processor in which processing solutions, such as developing solution, bleaching solution, etc., are applied to photographic materials during processing is one source of recoverable water. Another source is the humid air from a dryer used to dry the photographic material. A third source of water vapor is from the evaporation of waste photographic processing solutions within a chamber or section of the processor. The condenser unit may also be used to recover water from ambient air in the vicinity of the processor.

In the present invention, the system to recover water from humid air sources within the processor is integrated into the processor, making the processor more compact. The system to evaporate photographic processing waste is also integrated into the photographic processor The evaporation of waste processing solutions takes advantage of the type of processor being used. An example of such a processor is described in GB 0023091.2, which has a hot air enclosure to provide the temperature environment for photographic processing and for the evaporation of the waste effluent solutions. The effluent is collected and dispersed on absorbent matting. New Pig Ltd. makes one such product (MAT267 Universal Ham-OTM PIG® Mat) which can be used.

The present invention therefore relates to a method of processing photographic material which comprises introducing the photographic material into a processor, wherein processing of the photographic material includes at least applying a processing solution to the material and circulating heated air through the processor, with the heated air becoming humid heated air as it circulates through the processor; contacting the humid heated air with a cold source to condense the humid heated air; and collecting water resulting from the contacting of the humid heated air with the cold source.

The present invention further relates to a processing arrangement which comprises a processor that is adapted to process photographic material, with the processor comprising at least a system for applying processing solution to the photographic material and a heated air source adapted to circulated heated air through the processor, wherein the heated air becomes humid heated air as it circulates through the processor; a cold surface adapted to contact and condense the heated humid air; and a water collector adapted to collect water which results from the contact of the heated humid air with the cold source.

DETAILED DESCRIPTION OF THE INVENTION

Figure 1A:
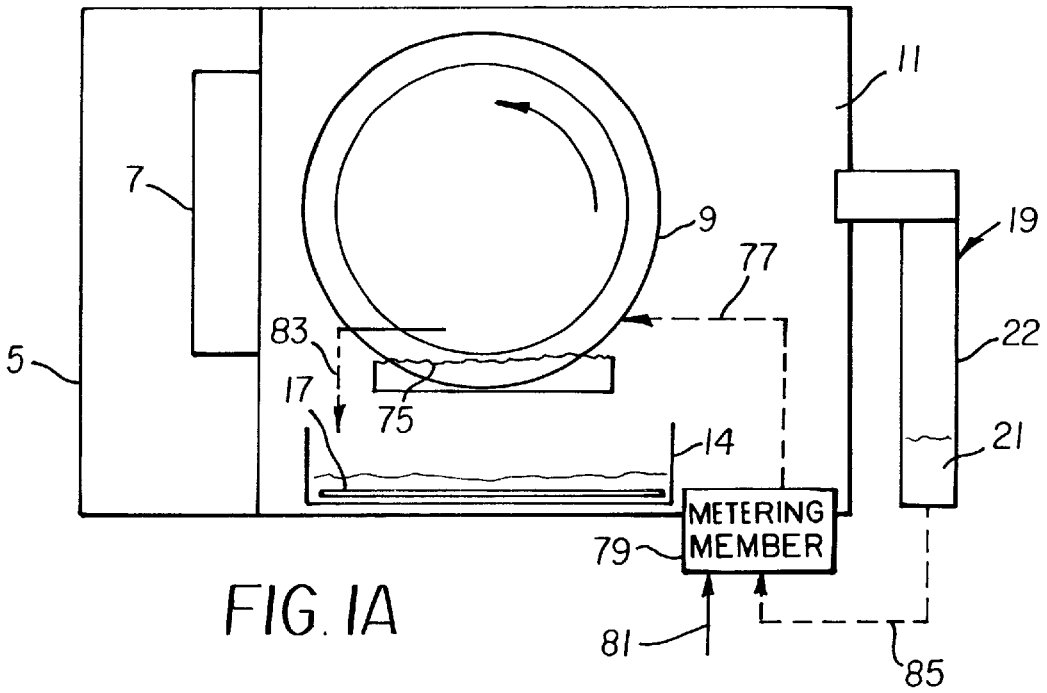
FIGS. 1A–1B show examples of a first embodiment of a processing arrangement in accordance with the present invention.

Referring now to the drawings, wherein like reference numerals represent identical or corresponding parts throughout the several views, FIGS. 1A–1B, 2 and 3 illustrate a water recovery apparatus and a waste absorbing matting in accordance with the present invention. More specifically, FIG. 1A illustrates a processing arrangement in the form of an integrated system for dry photographic waste formation and water recovery, in accordance with a first embodiment of the present invention.

As shown in FIG. 1A, the processing arrangement includes an integrated photographic processor 5, a heater/fan assembly 7, a drum processor 9 within a hot air box 11, a container or tray 14 with a removable absorbent matting 17 therein to collect waste liquid effluent or processing solution for evaporation to solid waste, and a cold trap 19 to condense water vapor from hot air box 11 and/or a processor dryer (not shown) used to dry the processed photographic material. Cold trap 19 includes a collecting tube or vessel 22 to collect water 21.

In the arrangement of FIG. 1A, hot air is circulated from heater/fan assembly 7 into hot air box 11 containing processing drum 9 and then into cold trap 19. Cold trap 19 may be the cold side of a heat pump, or other condensing device. A recovered water 21 in tube or vessel 22 can be reused to process (for example, wash) more photographic material. Thus, recovered water 21 can be collected from hot air box 11 and/or a processor dryer. Absorbent material or matting 17 is removably placed in container 14 and solid waste that accumulates on absorbent material or matting 17 can be safely removed for disposal.

More specifically and with reference to FIG. 1A, a film or photographic material which is to be processed within photographic processor 5 would be processed in a known manner within, for example, a rotating drum 9, by being contacted with processing solution 75. As an example, the photosensitive film can be mounted in a known manner in processing drum 9 and rotated along with the drum so as to be periodically immersed in processing solution 75. As a further option, the photosensitive material can be rotated with respect to drum processor 9. Processing solution 75 can be supplied to drum 9 through, for example, a supply system which includes a solution line 77 that communicates with a processing solution supply metering member 79 that receives processing solution from a processing solution source 81. Metering member 79 can be positioned within hot air box 11, or external of hot air box 11. Waste solution is discharged from drum processor 9 via, for example, a vacuum system 83 and supplied to waste solution tray 14. As described above, waste solution tray 14 includes absorbent matting material 17 which is adapted to evaporate the waste processing solution to a solid waste that is subsequently removed for disposal. In addition, processor 5 includes a heater/fan assembly 7 which supplies heated circulated air through hot air box 11. The heated circulated air becomes humid heated air as it passes across drum processor 9. This heated humid air condenses as it contacts a cold surface such as cold trap 19 and results in water 21 collecting in vessel 22. Although a drum processor is shown, it is recognized that the present invention is not limited thereto and that the invention can be practiced with other types of processors that include a controlled temperature chamber.

In a feature of the present invention, collected water 21 can be recirculated back to processor 9 via, for example, a supply line 85. Supply line 85 leads the collected water 21 back to metering member 79 which directs the recycled water back to processing drum 9 during, for example, a cleaning cycle. Of course, it is recognized that the present invention is not limited to recycling the recovered water back to processing drum 9, and that the recycled water can be directed to any component of the processor 5 which is desired to be cleaned or processed. Further, photographic processor 5 as shown can perform the processing steps necessary for the processing of photographic material within hot air box 11. It is, however, recognized that as a further option, the disclosed system can include a separate washing section, and as a still further option, the collected water can be directed to the separate washing section.

Figure 1B:
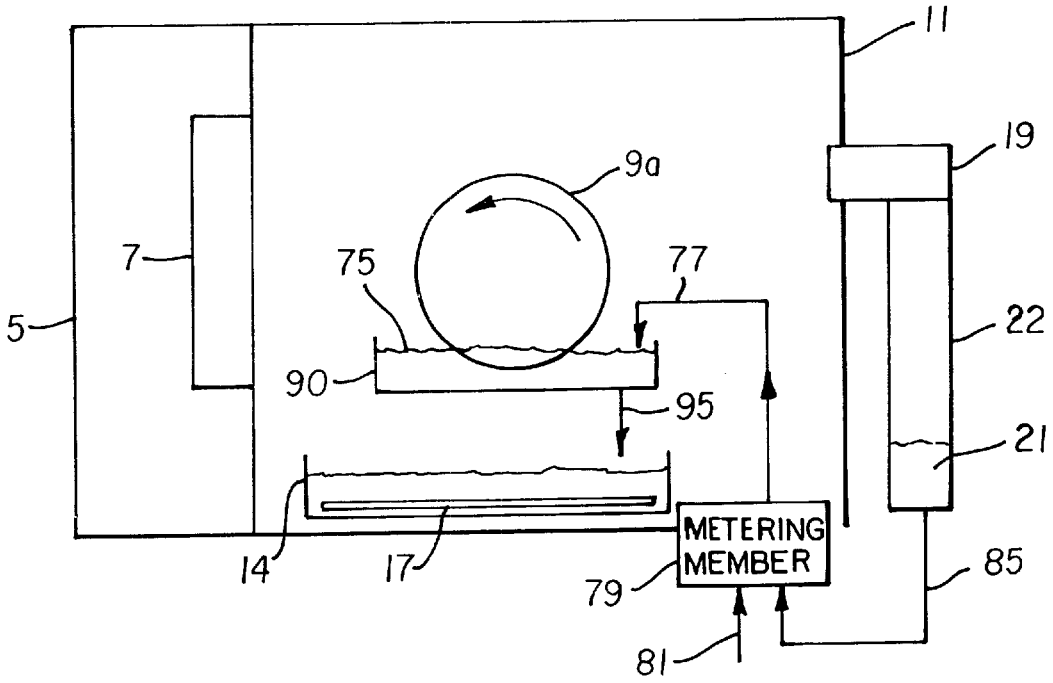

FIG. 1B illustrates a further example of a processing arrangement in accordance with the present invention. In the embodiment of FIG. 1B, those elements which are substantially equivalent to the elements of FIG. 1A are identified with the same reference numerals. In the embodiment of FIG. 1B, a processing drum 9*a* can be adapted to hold a photographic material on an exterior surface. Further, processing drum 9*a* is mounted such that a lower portion of processing drum 9*a* is immersed in processing solution 75 provided in a tray 90. Therefore, with the system of FIG. 1B, as processing drum 9*a* rotates with photographic material mounted thereon, it will cause the material to be immersed in processing solution 75 provided in tray 90. As a further option, processing drum 9*a* can include a surface that is adapted to carry processing solution to photographic material fixedly mounted in close proximity to the exterior surface of processing drum 9*a*.

As in the embodiment of FIG. 1A, processing solution 75 is applied to tray 90 via a metering member 79 and a processing solution source 81. Waste processing solution can be discharged from tray 90 into tray 14 via a drain 95. As described above, tray 14 includes absorbing matting 17 therein. Also, like the embodiment of FIG. 1A, the embodiment of FIG. 1B includes a cold source in the form of a cold trap 19 having a vessel 22 which recirculates recovered water 21 via line 85, metering member 79 and line 77 back to processing solution tray 90. Thus, with respect to the creation of solid waste and the recirculation of water, the embodiment of FIG. 1B operates similar to the embodiment of FIG. 1A.

Figure 2:
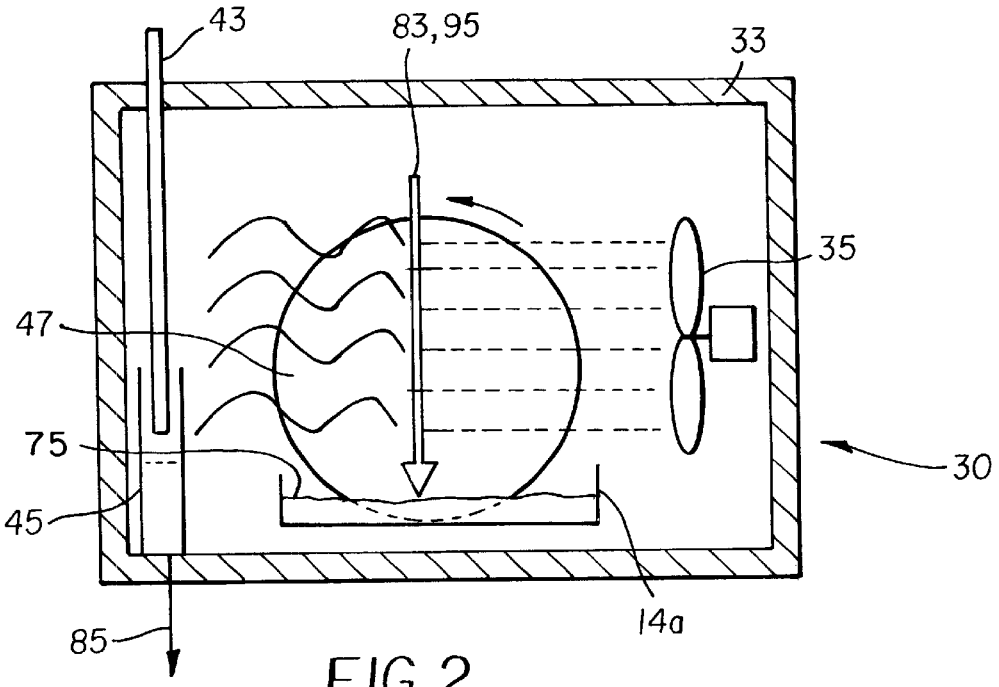
FIG. 2 illustrates a second embodiment of the processing arrangement of the present invention.

FIG. 2 illustrate a further embodiment in which evaporation of waste effluent or processing solution from an absorbent matting is achieved by moving the matting to repeatedly wet it with effluent liquid or solution. In the arrangement of FIG. 2, a processing arrangement 30 can include a thermally lagged cavity drier hot box 33 or processor cavity. A fan/heater assembly 35 directs hot air over a drum processor as in FIGS. 1A, 1B. Waste effluent or processing solution being discharged via lines 83, 95 similar to FIGS. 1A, 1B is schematically illustrated in FIG. 2. This waste processing solution is collected in a tray 14*a*. However, unlike tray 14 of FIGS. 1A, 1B, tray 14*a* does not include a matting material. A cold surface or rod 43 can be provided within box 33 so as to extend into a water recovery vessel or tube 45.

The embodiment of FIG. 2 further differs from the embodiment of FIGS. 1A–1B with respect to the placement of the absorbent matting. More specifically, rather than placing the absorbing matting in a tray below a processing drum as in FIGS. 1A, 1B, in the embodiment of FIG. 2 absorbing matting 47 can be attached to, mounted or secured to a rotating support such as, processing drum 9, 9*a* (FIGS. 1A, 1B) or some other rotating member. More specifically, absorbent matting 47 can be placed on any exterior surface of rotating drum 9, 9*a* in a manner which permits the absorbent matting to be periodically immersed in waste solution in tray 14*a* as illustrated in FIG. 2.

Therefore, during use of the embodiment of FIG. 2, hot air passing across processing drum 9 or 9*a* (FIGS. 1A, 1B) by way fan/heater assembly 35 will be condensed at cold surface 43, and the water resulting from this contact will be collected in recovery vessel or tube 45. The collected water in water vessel 45 can be reused to process more photographic material. That is, like the embodiments of FIGS. 1A, 1B, the collected water can be recycled back to the processor for further processing or washing via line 85 in the same manner as explained with reference to FIGS. 1A, 1B.

As also described above and shown in FIG. 2, matting 47 may be attached to any exterior surface of the drum of the processor or any other device that contacts the matting with liquid effluent or waste processing solution to wet it on a periodic basis. Wet matting 47 then contacts the circulated hot air that is inside processor chamber 33 or delivered from a heater. As already described, warm humid air is brought into contact with cold surface 43 to condense and recover water for reuse in the processor, while crystalline waste collects on absorbent matting material 47. This waste can thereafter be disposed in any manner desired by the user.

Figure 3:
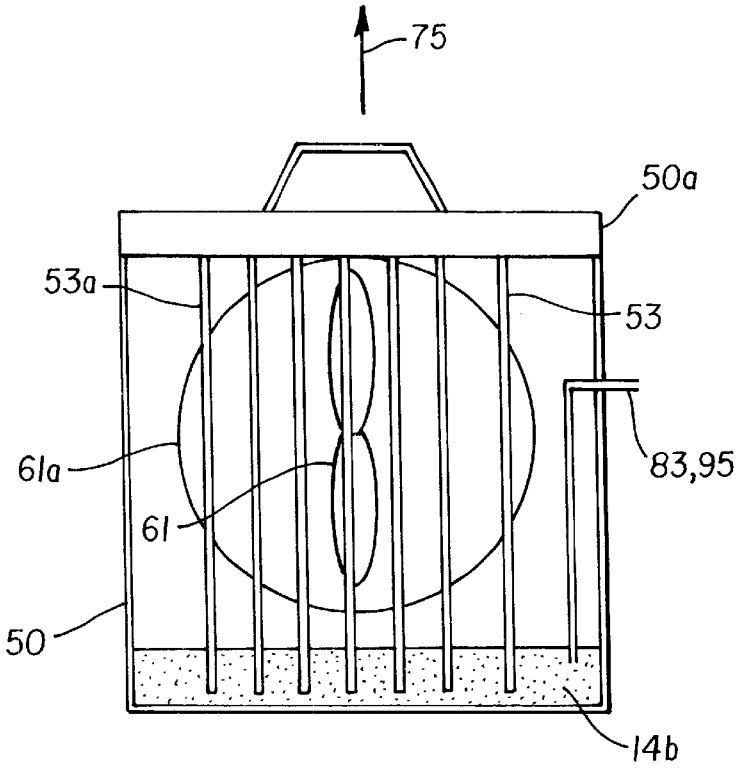
FIG. 3 illustrates a third embodiment of the present invention.

FIG. 3 illustrates a further embodiment in accordance with the present invention. As shown in FIG. 3, a replaceable cartridge 50 containing absorbent matting 53 for waste effluent evaporation can be used. With the arrangement of FIG. 3, air is allowed to pass through both sides of matting 53 to effectively double the surface area for evaporation. The processor is designed so that liquid waste effluent or waste processing solution is fed into a collection tray 14*b* of replaceable cartridge 50 via discharge line 83 (FIG. 1A) or discharge line 95 (FIG. 1B). This is schematically shown in FIG. 3. In the embodiment of FIG. 3, the matting is not placed in the tray (FIGS. 1A, 1B) or on an exterior surface of a processing drum (FIG. 2), but instead is in the form of separate sheets 53*a* which extend from an upper cartridge portion 50*a*. Matting 53 is arranged so that a lower end of each sheet 53*a* is immersed with the effluent or waste solution in tray 14*b* and becomes wet with liquid waste by means of a capillary action. As a further option, as opposed to a capillary action, the waste solution can instead be supplied from upper cartridge portion 50*a*. More specifically, upper cartridge portion 50*a* can be in the form of a manifold having openings which correspond to each of the sheets 53*a* of matting 53. Waste solution introduced into portion 50*a* can then flow down each of the sheets 53*a* of matting 53. Hot air from a heater 61*a* and fan 61 which may not be part of cartridge 50 is fed into the cartridge where it comes into contact with a high surface area of absorbent matting 53. The warm humid air from the cartridge is then fed to a cold surface/condenser chamber (FIGS. 1A, 1B or 2) where the evaporated water is recovered for reuse. The waste solution on matting 53 can be evaporated and disposed as solid waste as described with reference to FIGS. 1A, 1B and 2. With the arrangement of FIG. 3, when the cartridge is dry and near capacity, a user simply has to pull cartridge 50 from the processor in the direction of arrow 75 and dispose of the cartridge accordingly.

Examples of the types of matting and processors which can be used in the present invention will now be described.

The matting preferably has a large absorbency (3.3 L/$m^2$) and fibers which help to increase the effective surface area for evaporation, while acting as a support for any crystal formation. Evaporating with matting is desirable to evaporating in a flat dish which has been shown to have a slow rate of evaporation relative to the matting.

As explained above, the matting may be housed in the hot air enclosure or processing chamber of the processor and supplied with effluent or processing solution. Alternatively, it may be housed in a separate compartment of the processor, and it may be in the form of a removable, replaceable cartridge. The matting area should be chosen so that it can accommodate the volume produced by the machine operating at its maximum rate. Air is passed over the matting and the water is evaporated leaving eventually solid dry matting containing the chemical effluent or waste processing solution. The evaporated water is recovered by the use of a cold condenser and collection vessel, but any means to recover the water from damp air can be used. The recovered water is then suitable for mixing with any of the delivered chemicals or used as a wash.

The absorbent matting material can be made of virtually any fibrous material that is compatible with the photographic processing solution waste liquid. Such materials include both natural and synthetic fibrous materials including cellulose, cotton, wool, kapok, hemp, jute, flax, and straw, but hydrophilic fibrous materials are preferred because they will more readily become wet with the liquid waste solution and thereby enhance evaporation. Of course the present invention is not limited to matting having fibrous material. It is noted that the matting can be made of any type of absorbent material that is compatible with processing solution and is insoluble in the processing solution.

The method of waste liquid evaporation, and the method of water recovery from humid air sources within the photographic processor are preferably applied to batch processors which include a processing chamber in which the photographic processing operations are conducted. Such a chamber has a thermostatically controlled atmosphere that helps to maintain the photographic material and the photographic processing solutions applied to that material at a prescribed temperature so that rapid and effective chemical processing is performed. As an example, such a chamber can be used with processors that are described in, for example, GB 0023091.2, in U.S. Pat. No. 5,692,188, or in U.S. Pat. No. 5,402,195.

Evaporation of liquid waste takes place at atmospheric pressure at approximately the temperature of the photographic processing chamber, which is from approximately 40° C. to 80° C.

The liquid waste can be evaporated from a container that is within the chamber in which photographic materials are processed, or the container for evaporation can be in a separate chamber into which hot air is fed from the chamber in which photographic materials are processed. Humid air from the hot air box and any connected evaporation chambers is then led to a condenser device for the recovery of water from the warm humid air. As an example, the condenser device may be the cold side of a heat pump.

The following are non-limiting examples of photographic waste effluent evaporation from absorbent matting material; and water recovery from humid air sources within a photographic processor based on the present invention:

A 24 exposure length of 35 mm photographic color negative film was processed with the following volumes of solutions in sequence, putting each solution in a waste effluent container after its use:

| | |
|---|---|
| Developer | 21 ml |
| Bleach | 21 ml |
| Fixer | 14 ml |
| Four water washes | 56 ml total* |

The total volume of effluent produced was about 112 ml.

Assuming a maximum rate of processing of 20 rolls per hour, then 2.24 L per hour of effluent would be produced. The area of a matting, MAT267 Universal Ham-OTM PIG® Mat, to totally absorb 2.24 L is 0.68 $m^2$. The rate of water loss from one side of this effluent soaked matting in a processor chamber at 60° C. was measured to be 42 ml/min/$m^2$. From 0.68 $m^2$ we can evaporate 28.4 ml/min or 2.24 Liters in 79 minutes. With this area of matting we would either need to only process 15 films per hour or increase the area of the matting to allow the evaporation to keep up with the production of effluent. For example, air flow around the matting could be increased to include both sides of the material.

The processing solution formulas were as follows:

| Developer Composition | |
|---|---|
| $Na_2SO_3$(anhydrous) | 10.53 g/l |
| Hydroxylamine sulfate | 3.0 g/l |
| Diethylenetriamine-pentaacetic acid | 2.6 g/l |
| KI | 0.002 g/l |
| Polyvinylpyrrolidone(K15) | 3 g/l |
| NaBr | 2.8 g/l |
| $K_2CO_3$ | 40 g/l |
| Kodak Developing Agent CD4 | 15 g/l |
| pH | 10.48 |
| Photo-Flo* | 1 ml/l |

| Bleach Composition | |
|---|---|
| grams 1,3-Propanediaminetetraacetic acid (MW 306.24) | 156.8 |
| grams Succinic Acid (MW 118.09) | 105.0 |
| grams NH4Br (FW 98) | 60.0 |
| grams Fe(NO3)3*9H2O (FW 404) | 188.1 |
| NH4OH | 200 mL |
| Bring to a Volume of: with Water | 950 mL |
| pH Adjust to: with HNO3 or NH4OH | 4.75 |
| Bring to Final Volume of: | 1.0 liters |

| Fixer Composition | |
|---|---|
| Ammonium sulfite | 21.5 g/l |
| ammonium thiosulfate | 264 g/l |
| EDTA.$Na_2$2$H_2O$ | 1.08 g/l |
| 1,2,4-Triazole-3-thiol | 1.0 g/l |
| pH | 7.9 |
| Photo-Flo* | 1 ml/l |

*Kodak Professional Photo-Flow ™ 200 Solution is manufactured by Eastman Kodak Company (CAT No. 146 4510)

The invention has been described in detail with particular reference to certain preferred embodiments thereof, but it will be understood that variations and modifications can be effected within the spirit and scope of the invention.

What is claimed is:

1. A method of processing photographic material comprising:

processing a photographic material in a processor, wherein the processing of the photographic material includes at least applying a processing solution to the material and circulating heated air through the processor, said heated air becoming humid heated air as it circulates through the processor;

contacting said humid heated air with a cold surface to condense the humid heated air; and collecting water resulting from the contacting of the humid heated air with the cold surface.

2. A method according to claim 1, further comprising:

recirculating the collected water back to the processor for processing of photographic material.

3. A method according to claim 1, further comprising:

recirculating the collected water to the processor for use in washing at least one of the photographic material and components of the processor.

4. A method according to claim 1, further comprising:

placing an absorbent matting material in said processor at a position which permits the collection of waste processing solution in said processor, said absorbent matting material being adapted to evaporate said waste processing solution to a solid waste.

5. A method according to claim 4, further comprising:

collecting said solid waste for disposal.

6. A method according to claim 4, wherein said matting material comprises a fibrous material that is compatible with the waste processing solution.

7. A method according to claim 4, wherein said matting material comprises an absorbent material which is compatible with said waste processing solution and is insoluble in said waste processing solution.

* * * * *